US009753423B2

(12) United States Patent
Kopp

(10) Patent No.: US 9,753,423 B2
(45) Date of Patent: Sep. 5, 2017

(54) METHOD AND DEVICE TO DETECT NEGATIVELY EFFECTED REGIONS ON AN IMAGE CARRIER

(71) Applicant: Oce Printing Systems GmbH & Co. KG, Poing (DE)

(72) Inventor: Christian Kopp, Planegg (DE)

(73) Assignee: Océ Printing Systems GmbH & Co. KG, Poing (DE)

( * ) Notice: Subject to any disclaimer, the term of this patent is extended or adjusted under 35 U.S.C. 154(b) by 0 days.

(21) Appl. No.: 15/015,513

(22) Filed: Feb. 4, 2016

(65) Prior Publication Data

US 2016/0231685 A1 Aug. 11, 2016

(30) Foreign Application Priority Data

Feb. 10, 2015 (DE) ..... 10 2015 101 854

(51) Int. Cl.
*G03G 15/00* (2006.01)

(52) U.S. Cl.
CPC ..... *G03G 15/5033* (2013.01); *G03G 15/553* (2013.01); *G03G 15/751* (2013.01)

(58) Field of Classification Search
CPC ..... G03G 15/5033
USPC ..... 399/26
See application file for complete search history.

(56) References Cited

U.S. PATENT DOCUMENTS

| | | | | |
|---|---|---|---|---|
| 5,903,796 | A * | 5/1999 | Budnik | G03G 15/5037 399/26 |
| 6,014,532 | A * | 1/2000 | Takeichi | G03G 21/00 399/346 |
| 6,229,968 | B1 | 5/2001 | Martin et al. | |
| 6,493,061 | B1 * | 12/2002 | Arita | H04N 1/00002 355/18 |
| 7,362,450 | B2 * | 4/2008 | Zaman | G01N 21/952 356/237.2 |
| 7,869,099 | B2 * | 1/2011 | Mashtare | H04N 1/00002 358/406 |
| 2004/0008999 | A1 * | 1/2004 | Iino | G03G 15/0121 399/29 |
| 2004/0053151 | A1 * | 3/2004 | Hashimoto | G03G 5/10 430/69 |
| 2005/0118520 | A1 * | 6/2005 | Takeshima | G03G 5/10 430/60 |

(Continued)

FOREIGN PATENT DOCUMENTS

| | | | |
|---|---|---|---|
| DE | 10038399 | A1 | 4/2001 |
| DE | 102009038482 | A1 | 4/2011 |

(Continued)

*Primary Examiner* — David M Gray
*Assistant Examiner* — Geoffrey T Evans
(74) *Attorney, Agent, or Firm* — Schiff Hardin LLP

(57) ABSTRACT

In a method to determine a negative effect on a surface of an image carrier of a print group, a reflection spectrum is determined of a region of the surface of the image carrier, the reflection spectrum indicating an intensity of light for different wavelengths. The light is reflected from the region of the surface of the image carrier. A reference spectrum is determined for the region of the surface of the image carrier. The reflection spectrum is then compared with the reference spectrum. Depending on the comparison, the determination is made whether a negative effect is present at the region of the surface of the image carrier.

13 Claims, 5 Drawing Sheets

(56) References Cited

U.S. PATENT DOCUMENTS

| | | | | |
|---|---|---|---|---|
| 2005/0157327 | A1* | 7/2005 | Shoji | G06F 11/0754 358/1.14 |
| 2006/0194132 | A1* | 8/2006 | Hosoi | G03G 5/08221 430/56 |
| 2014/0212632 | A1 | 7/2014 | Bayer et al. | |
| 2016/0132013 | A1* | 5/2016 | Soma | H04N 1/603 358/1.1 |

FOREIGN PATENT DOCUMENTS

| | | | |
|---|---|---|---|
| DE | 102013201549 | B3 | 6/2014 |
| EP | 1271134 | A1 | 1/2003 |
| JP | 11183390 | A | 7/1999 |
| JP | 2014149526 | A | 8/2014 |

* cited by examiner

METHOD AND DEVICE TO DETECT NEGATIVELY EFFECTED REGIONS ON AN IMAGE CARRIER

BACKGROUND

The disclosure concerns an electrographic (in particular an electrophotographic) digital printer to print to a recording medium with toner particles that are transferred from an image carrier onto the recording medium.

Given such digital printers, a latent charge image of an image carrier is inked, for example by means of electrophoresis using a liquid developer. Alternatively, a dry toner may also be applied to the image carrier. The toner image that is created in such a manner is transferred (possibly indirectly via a transfer station) onto the recording medium. Ultimately, the print image is fixed on the recording medium. In the transfer step, an electrical field is used in order to transfer the toner image onto the recording medium.

For a successful and undisturbed (possibly electrophoretic) development step, it is important that the image carrier has a clean, uncontaminated surface. For example, if a developer film remains on the image carrier, flaws in the print image may thus arise. These may be remedied via an external cleaning of the image carrier. However, the image carrier may be mechanically damaged upon its removal and installation.

Alternatively or additionally, as described in DE102009038482A1 a cleaning of the image carrier (in particular of a photoconductor) may take place within the digital printer (for example by means of a cleaning brush). However, should flaws of the print image nevertheless occur, with the system described in DE102009038482A1 it cannot be established whether the flaw of the print image is to be ascribed to a contamination of the image carrier or to another negative effect (for example to a mechanical damage) on the image carrier. The suitable measures to remedy the flaw of the print image thus cannot be directly introduced. JP H11-183390A describes a system with which light that is reflected on a surface may be adjusted uniformly. DE10038399A1 describes a printing system with a reflection sensor to detect defects. EP1271134A1 describes a system to detect defects using scattered light.

SUMMARY

It is an object to efficiently and reliably detect a negative effect on the surface of the image carrier and, if possible, to detect a type of the negative effect on the surface of the image carrier of an electrographic digital printer. It should thereby be possible to detect the negative effect on the surface without a removal of the image carrier in order to avoid the risk of a mechanical damage of the image carrier upon removal/installation.

In a method to determine a negative effect on a surface of an image carrier of a print group, a reflection spectrum is determined of a region of the surface of the image carrier, the reflection spectrum indicating an intensity of light for different wavelengths. The light is reflected from the region of the surface of the image carrier. A reference spectrum is determined for the region of the surface of the image carrier. The reflection spectrum is then compared with the reference spectrum. Depending on the comparison, the determination is made whether a negative effect is present at the region of the surface of the image carrier.

DETAILED OF EXEMPLARY EMBODIMENTS

Figure 1:
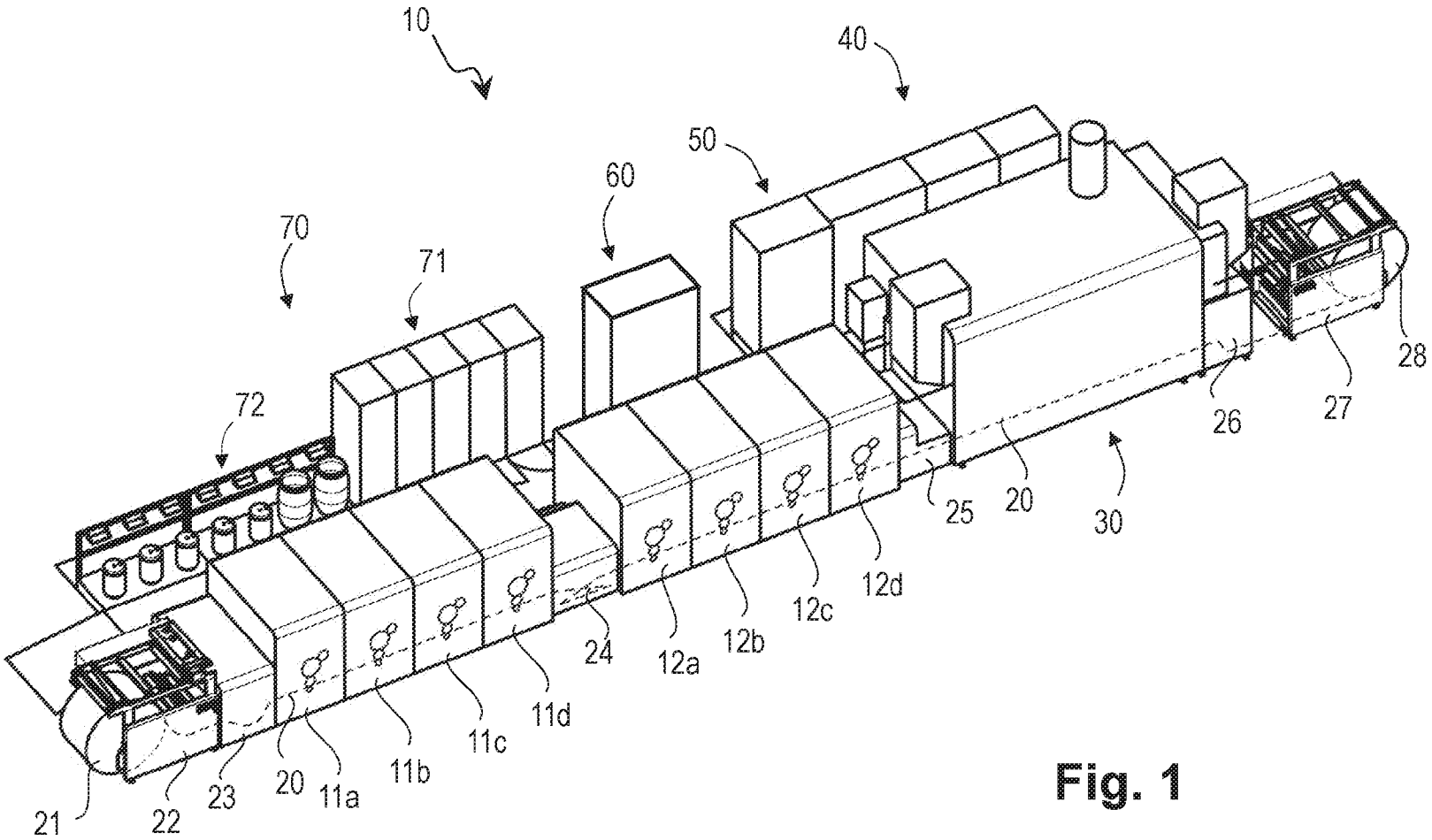
FIG. 1 is a view of a digital printer in an example configuration of the digital printer.

For the purposes of promoting an understanding of the principles of the invention, reference will now be made to the preferred exemplary embodiments/best mode illustrated in the drawings and specific language will be used to describe the same. It will nevertheless be understood that no limitation of the scope of the invention is thereby intended, and such alterations and further modifications in the illustrated embodiments and such further applications of the principles of the invention as illustrated as would normally occur to one skilled in the art to which the invention relates are included herein.

According to one aspect of an exemplary embodiment, a method to determine a negative effect on the surface of an image carrier of a print group of an electrographic digital printer is described. The method includes the determination of a reflection spectrum of a region of the surface of the image carrier. Furthermore, the method includes the determination of a reference spectrum for the region of the surface of the image carrier. The method additionally includes the comparison of the reflection spectrum with the reference spectrum. Moreover, the method includes the determination—depending on the comparison—of whether a negative effect is present in the region of the surface of the photoconductor.

According to an additional aspect, a print group for an electrographic digital printer is described. The print group comprises an image carrier for the creation of a latent print image and for the generation of an inked image (also designated as a toner image) by receiving toner particles depending on the latent print image. Moreover, the print group comprises a transfer station for transferring the inked image onto a recording medium, as well as a cleaner to clean the image carrier after transfer of the inked image. Furthermore, the print group comprises a light source that is set up to illuminate a region of a surface of the image carrier, and a sensor that is set up to detect a reflection spectrum of a region of the surface of the image carrier. Moreover, the print group comprises an analyzer that is set up to detect a negative effect on the region of the surface of the image carrier on the basis of the reflection spectrum.

In the following, exemplary embodiments of the invention are described in detail using schematic drawings.

According to FIG. 1, an example of a digital printer 10 for printing to a recording medium 20 has one or more print groups 11*a*-11*d* and 12*a*-12*d* that print a toner image (print image 20'; see FIG. 2) onto the recording medium 20. As shown, a web-shaped recording medium as a recording medium 20 is unspooled from a roll 21 with the aid of a take-off 22 and is supplied to the first print group 11*a*. The print image 20' is fixed on the recording medium 20 in a fixer 30. The recording medium 20 may subsequently be taken up on a roll 28 with the aid of a take-up 27. Such a configuration is also designated as a roll-to-roll printer. Details with regard to the example of a digital printer 10 that is shown in FIG. 1 are described in the patent document DE 10 2013 201 549

B3 and in the corresponding patent applications JP 2014/149526 A and US 2014/0212632 A1. These documents are incorporated herein by reference.

Figure 2:
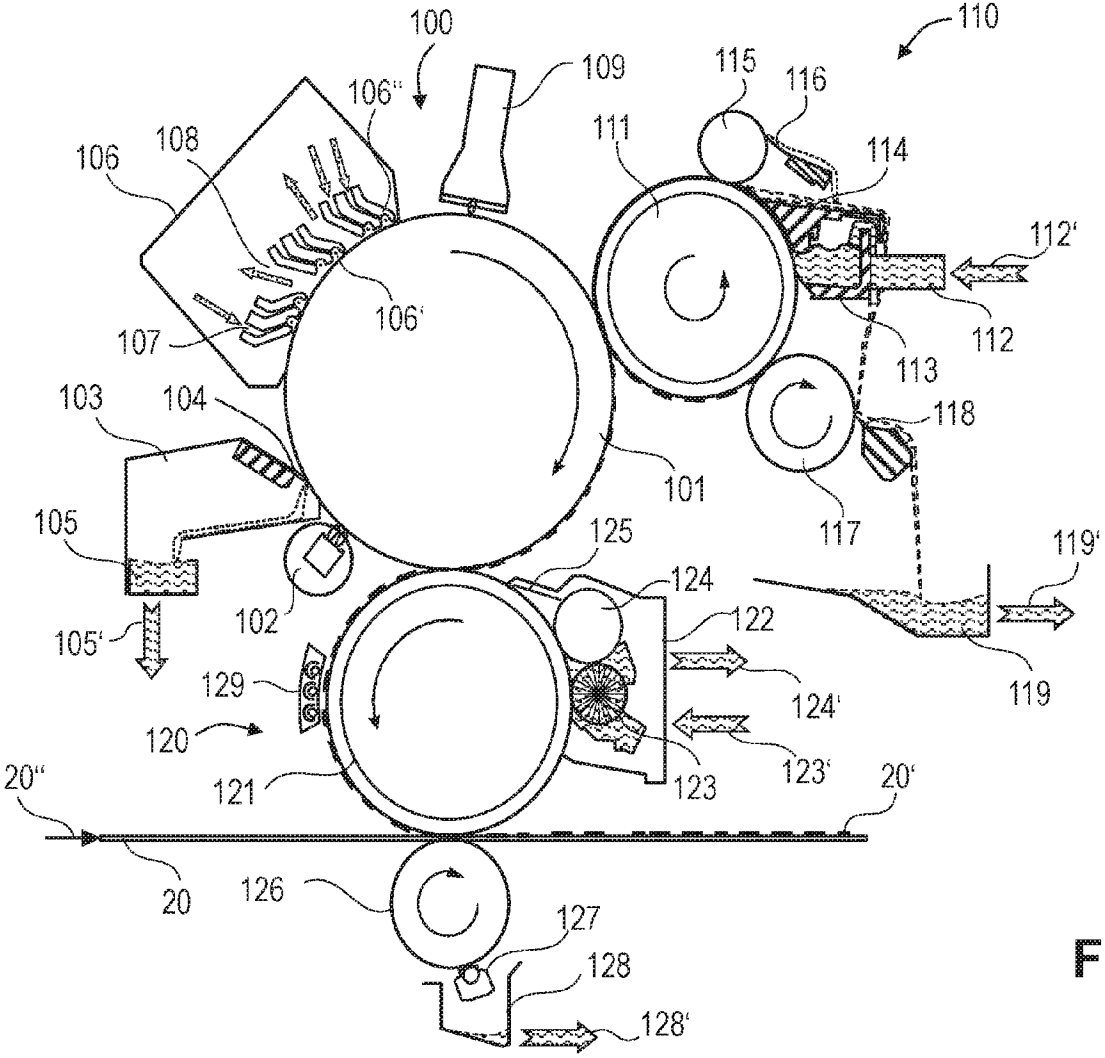
FIG. 2 is a schematic design of a print group of the digital printer according to FIG. 1.

The principle design of a print group 11, 12 is shown in FIG. 2. The print group depicted in FIG. 2 is based on the electrophotographic principle, in which a photoelectric image carrier (in particular a photoconductor 101) is inked with charged toner particles with the aid of a liquid developer, and the image that is created in such a manner is transferred to the recording medium 20. The print group 11, 12 is substantially comprised of an electrophotography station 100, a developer station 110 and a transfer station 120.

The core of the electrophotography station 100 is a photoelectric image carrier that has on its surface a photoelectric layer (what is known as a photoconductor). The photoconductor here is designed as a roller (photoconductor roller 101) and has a hard surface. The photoconductor roller 101 rotates past the various elements to generate a print image 20' (rotation in the arrow direction).

The photoconductor 101 is initially cleaned of all contaminants. For this, an erasure light 102 is present that erases charges that still remain on the surface of the photoconductor 101. The erasure light 102 can be calibrated (is locally adjustable) in order to achieve a homogeneous light distribution. The surface may therefore be pre-treated uniformly.

After the erasure light 102, a cleaning device 103 mechanically cleans off the photoconductor 101 in order to remove toner particles that are possibly still present on the surface of the photoconductor 101, possible dirt particles and remaining carrier fluid. The cleaned-off carrier fluid is supplied to a collection container 105. The collected carrier fluid and toner particles are prepared (filtered as necessary) and fed—depending on color—to a corresponding liquid color reservoir, i.e. to one of the storage containers 72 (see arrow 105').

The photoconductor 101 is subsequently charged by a charger 106 to a predetermined electrostatic potential. For this, multiple corotrons (in particular glass shell corotrons) are preferably present. Arranged after the charger 106 is a character generator 109 that, via optical radiation, discharges the photoconductor 101 per pixel depending on the desired print image 20'. A latent image is thereby created that is later inked with toner particles (the inked image corresponds to the print image 20'). An LED character generator 109 is preferably used in which an LED line with many individual LEDs is arranged stationary over the entire axial length of the photoconductor roller 101. The number of LEDs and the size of the optical mapping points on the photoconductor 101 determine (among other things) the resolution of the print image 20' (typical resolution is 600×600 dpi).

The latent image generated by the character generator 109 is inked with toner particles by the developer station 110 in order to generate an inked image. The developer station 110 has for this a rotating developer roller 111 that directs a layer of liquid developer towards the photoconductor 101.

The inked image rotates with the photoconductor roller 101 up to a first transfer point at which the inked image is substantially completely transferred to a transfer roller 121. After the transfer of the print image 20' to the transfer roller 121, the print image 20' (toner particles) may optionally be recharged or charged with the original polarity by means of a charger 129 (a corotron, for example) in order to be able to subsequently better transfer the toner particles from the transfer roller 121 to the recording medium 20.

The recording medium 20 travels through between the transfer roller 121 and a counter-pressure roller 126, in the transport direction 20". The contact region (nip) represents a second transfer point at which the toner image is transferred to the recording medium 20. The recording medium 20 may be produced from paper, paperboard, cardboard, metal, plastic and/or other suitable and printable materials. Additional details with regard to the example of a print group 11, 12 that is depicted in FIG. 2 are described in the patent document DE 10 2013 201 549 B3, and in the corresponding patent applications JP 2014/149526 A and US 2014/0212632 A1.

As presented above, the present document deals with efficiently and reliably detecting a negative effect on the surface of an image carrier (in particular of a photoconductor 101) without thereby needing to remove the image carrier from the print group 11, 12. If possible, a type of the negative effect on the surface of the image carrier (for example a film formation on the surface and/or a mechanical damage to the surface) may thereby also be detected.

In the following, the photoconductor 101 of an electrophoretic printing system 10 is discussed as an example. It is noted that the described aspects are analogously applicable to image carriers of electrographic printing systems, for example to the photoconductor of an electrophotographic printing system and/or to the image carrier of a magnetographic printing system.

Figure 3:
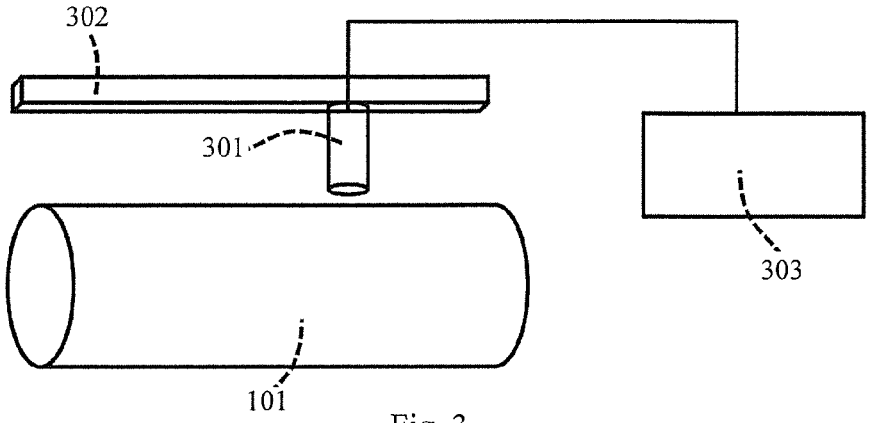
FIG. 3 is an example of a device to detect a negative effect on the surface of a photoconductor.

As depicted in FIG. 3, a measurement slit 302 may be integrated or adapted into the print group 11, 12 for analysis of the surface of the photoconductor 101. The measurement slit 302 may have a spectroscopic sensor 301 with which the entire photoconductor surface (given a rotating photoconductor 101) may be scanned or sampled in the print group 11, 12, in particular given the presence of print image flaws. A reflection spectrum may thus be generated for every region of the surface of the photoconductor 101.

The respective scanned region may have a predefined geometric extent, in particular a predefined width lateral to the rotation direction of the photoconductor 101 (for example 1 mm or less) and a predefined length in the rotation direction of the photoconductor 101 (for example 1 mm or less). For example, the respective scanned region may respectively correspond to a pixel or image point (or a group of image points) that is printed by the digital printer 10 onto the recording medium 20. For every image point (or for a group of image points), it may thus be determined whether a negative effect is present or not.

The surface of the photoconductor 101 may thus be separated into a plurality of such scanned regions, and a reflection spectrum may be determined for each of these regions. On the basis of the reflection spectrum, for each of these regions it may be determined whether the surface of the photoconductor 101 has a negative effect or not in the respective region. Furthermore, which type of negative effect is present may be determined on the basis of the reflection spectrum.

In particular, an analyzer 303 may analyze the reflection spectrum for a region of the surface of the photoconductor 101 and, by means of a predefined criterion, decide whether the region has film formations or contaminations that have an effect on the print image, or whether the region is clean. Furthermore, mechanical damage to the surface of the photoconductor 101 may be detected. The analyzer may include one or more circuits and/or processors configured to perform the analysis of the reflection spectrum.

Given use of a spectroscopic analysis, the surface of the photoconductor 101 is illuminated with a light source per point or per line (for example image point by image point or image line by image line). UV light (for example with a wavelength of less than 400 nm) is thereby preferably not used since this light may degrade the photoconductor 101. At each point of the rotating photoconductor 101, a spectrum may be recorded with a sensor (for example with a spectrometer) 301 arranged at a measurement slit 302. The rotation speed of the photoconductor 101 is thereby preferably adapted to the sample rate of the sensor 301.

FIG. 3 shows a cylindrical photoconductor 101 that is driven and thus may rotate. A spectroscopic sensor 301 with which the photoconductor surface may be axially scanned is positioned at a measurement slit 302 above the photoconductor surface. Given the use of a fiber-optic sensor 301, the photoconductor surface may be illuminated via a single fiber and the reflection spectrum may be detected. The signals of the sensor 301 are evaluated with an analyzer (with a computer) 303, for example. Filmed or contaminated regions of the surface of the photoconductor 101 may be identified via analysis of the reflection spectrum.

Figure 4A:
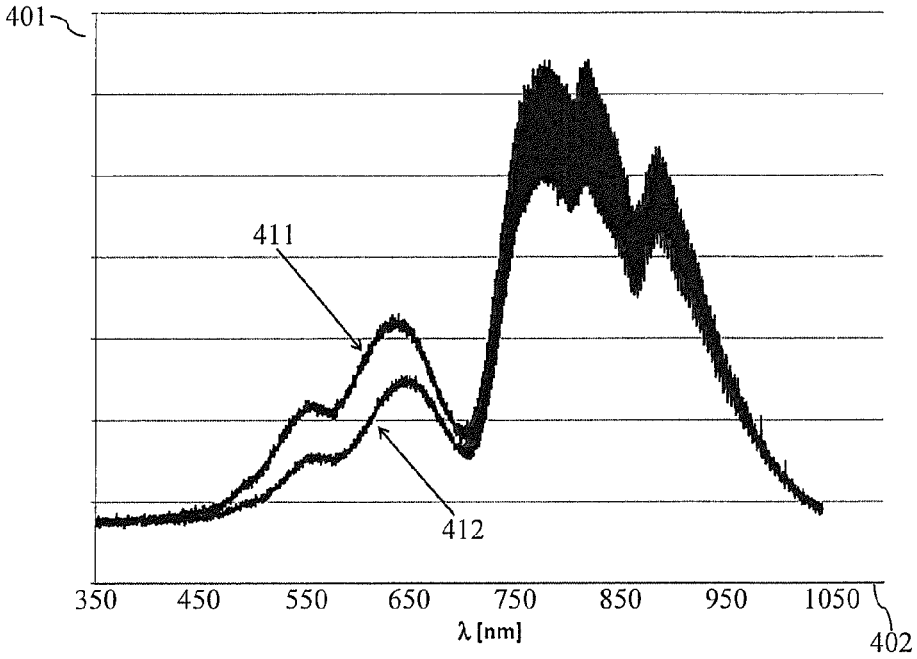
FIG. 4*a*, 4*b*, 4*c* are examples of reflection spectra of the surface of a photoconductor.

As depicted in FIG. 4*a*, the analysis of the reflection spectrum in the range of wavelengths 402 from approximately 550 nm to 650 nm (for toner of the color magenta) shows a significant difference between a filmed region and a clean region on the photoconductor 101. The reflection spectrum 412 in a filmed region is markedly attenuated in comparison to the reflection spectrum 411 in a clean region. In other words, the intensity 401 of the reflection spectrum 412 in a filmed region is markedly lower than the intensity 401 of the reflection spectrum 411 in a clean region.

The reflection spectrum 411 in a clean region may be stored as a reference spectrum and can be compared with a reflection spectrum 412 detected by the sensor 301. In particular, a distance measurement between the reference spectrum and the measured reflection spectrum 412 may be determined (in a defined range of wavelengths 402). Alternatively or additionally, it may be determined whether the measured reflection spectrum 412 lies within a predefined tolerance range of the reference spectrum. Whether a negative effect on the surface of the photoconductor 101 is present or not may then be decided depending on the value of the distance measure, or depending on whether the measured reflection spectrum 412 lies within the tolerance range. This means that a criterion—in particular a threshold—for individual wavelengths 402 may be defined via a comparison of the spectrum 412 of a photoconductor 101 with a film formation with the spectrum 411 of a cleaned photoconductor 101, with which criterion a differentiation of filmed regions of the surface of a photoconductor 101 having an effect on the print image and filmed regions of the surface of a photoconductor 101 not having an effect on the print image may be made.

In other words: FIG. 4*a* shows the reflection spectrum 411 (reflected intensity IR as a function of the wavelength 402) of a cleared, clean photoconductor surface in comparison to the reflection spectrum 412 of a filmed photoconductor surface. The reflection spectra 411, 412 have been recorded with a fiber-optic sensor 301. The contaminated, filmed surface shows a significantly reduced reflected intensity 401 (see reflection spectrum 412) in the wavelength range between 550 nm and 650 nm.

The reflection spectrum 412 of a filmed region of the surface of a photoconductor 101 typically depends on the color of the toner or on the color of the film formation. The reference spectrum that is used and/or the range of wavelengths 402 that is considered for the determination of the distance measure may thus depend on the color of the toner used on the photoconductor 101. In particular, the range of the wavelengths 402 of a reflection spectrum 412 that is used for the determination of a negative effect on the surface of the photoconductor 101 may include the wavelength 402 of the color of the toner applied to the photoconductor 101. The precision and the reliability of the detection of negative effects on the surface of the photoconductor 101 may thus be increased.

Defects (in particular mechanical defects or damages) of the surface of a photoconductor 101 may also be detected via the analysis of a measured reflection spectrum 412. In particular, such defects may be detected by means of an increased resolution of the reflection spectrum 412.

Figure 4B:
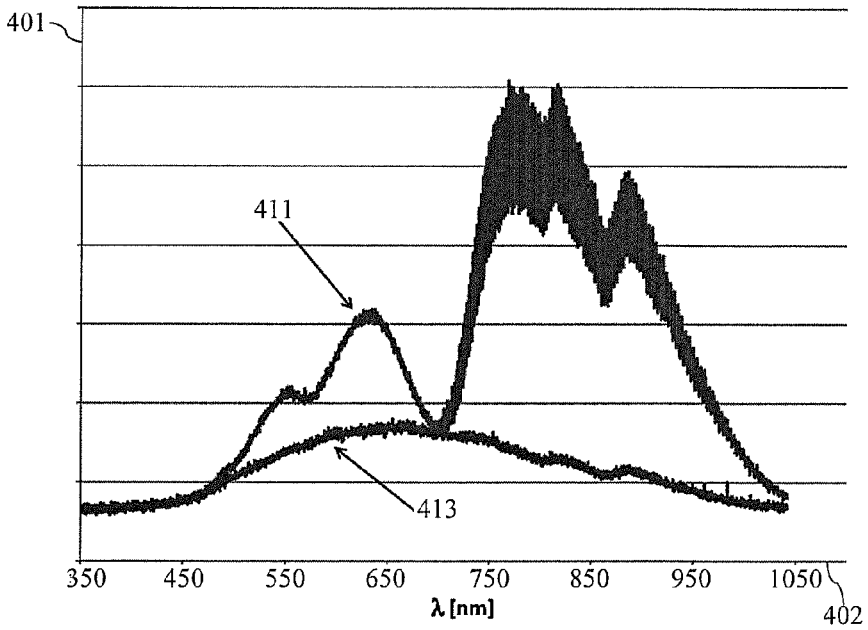
Figure 4C:
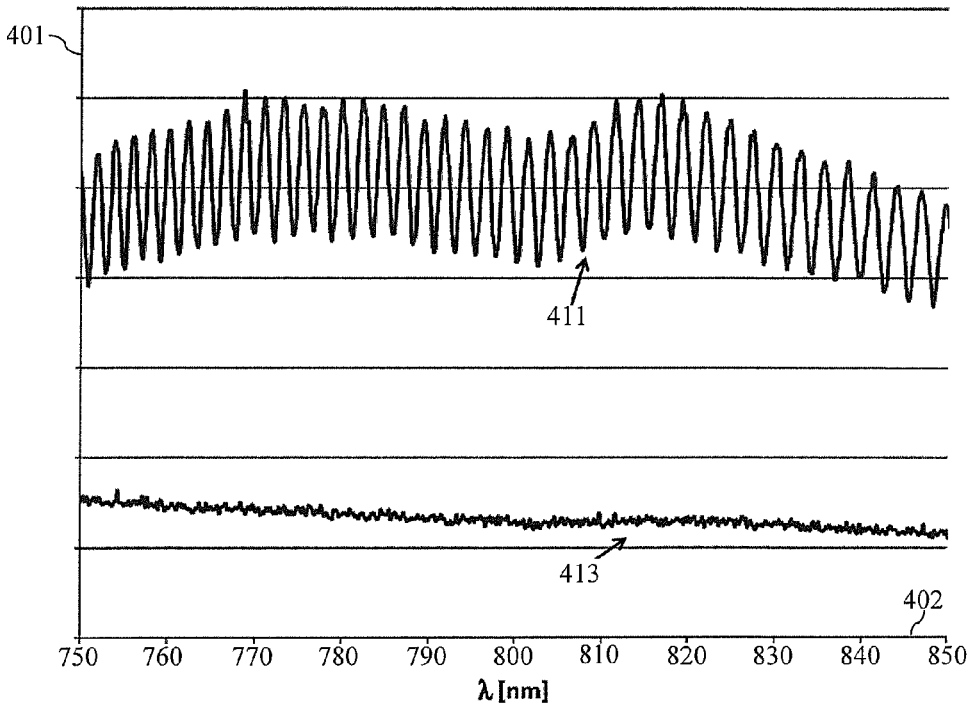

FIG. 4*b* shows the reflection spectrum 413 given the presence of damage to the photoconducting layer of the photoconductor 101 at a specific point of the photoconductor 101. The damaged point has a diameter of 1.2 mm. The photoconducting layer of the photoconductor 101 typically has a predefined thickness (of 20-40 μm, for example). At the damaged point, this photoconducting layer is coming off at least in part, such that the photoconductor 101 has a hole at the damaged point with a depth that corresponds approximately to the predefined thickness of the photoconducting layer. FIG. 4*c* shows an enlarged section from FIG. 4*b* between the wavelengths 402 of 750 nm and 850 nm. In FIG. 4*c* it is clear that the interferences (amplitude modulation of the reflected intensity 401, see spectrum 411) in this layer are absent due to the damage to the photoconducting layer. A damage to the photoconductor surface may thus be differentiated from a contamination of the photoconductor surface via an analysis of the reflection spectrum 413, in particular of the curve of the reflection spectrum 413 over the wavelength 402.

Suitable measures may be taken that correspond to the detected negative effect on the surface of the photoconductor 101. If applicable, a contamination of the surface of the photoconductor 101 may be remedied via suitable measures of the cleaner 103 of the print group 11, 12 (for example via the measures described in DE102009038482A1). On the other hand, a damage to the photoconductor surface typically requires an exchange of the photoconductor 101. The removal of the photoconductor 101 may thus be limited to cases in which a mechanical defect of the surface of the photoconductor 101 is detected.

A larger region of the surface of the photoconductor 101 may be inspected simultaneously via use of a (matrix) camera as a sensor 301 at the measurement slit 302 in connection with a suitable illumination (for example with an illumination at the absorption wavelength of the toner that is used). However, the space requirement for the sensor 301 thereby typically increases with increasing size of the inspected photoconductor surface, since the optic required for this is typically larger.

As an alternative or in addition to the determination of a reflection spectrum 412, 413, other measurement principles may be used, for example a measurement of eddy currents in the photoconductor 101, a measurement of the capacity of the photoconductor 101, the measurement of the potential of the surface of the photoconductor 101 by means of a potential probe, the use of ultrasound, the use of opto-acoustics etc.

The erasure light 102 of the electrophotography station 100 may be used as an illumination for the determination of a reflection spectrum 412, 413. The use of the erasure light may thereby possibly depend on the color of the toner of the print group 11, 12. For example, an erasure light 102 may be used which emits light with a wavelength 402 in the range of 700 nm. Reflection spectra 412, 413 may thus be determined in the range of 700 nm (for example for toner with an ink in the red range). The space requirement and the costs for the analysis of the surface of the photoconductor 101 may be reduced via the use of the erasure light 102.

The measurement slit 302 and the sensor 301 may be arranged so as to be insertable into and removable from the print group 11, 12. The measurement slit 302 and the sensor 301 may thus be installed in a print group 11, 12 as needed (for example given flaws in the print quality), and thus be used for a plurality of print groups 11, 12.

Figure 5:
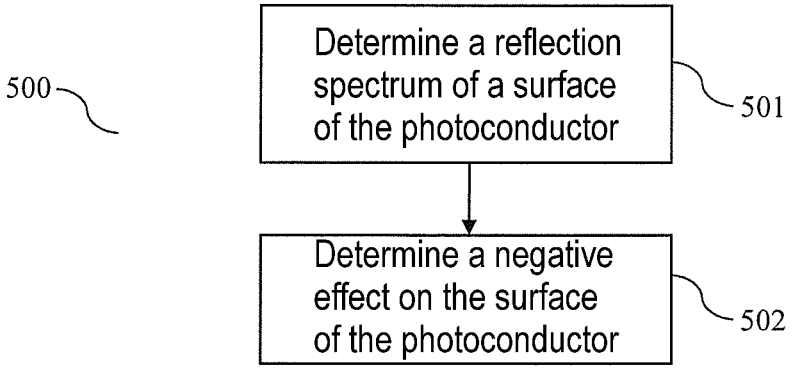
FIG. 5 is a workflow diagram of an example of a method to detect a negative effect on the surface of a photoconductor.

FIG. 5 shows a workflow diagram of an example of a method 500 for determination of a negative effect on the surface of an image carrier 101 of a print group 11, 12 of an electrographic (in particular an electrophotographic, for example electrophoretic) digital printer 10. The method 500 includes the determination 501 of a reflection spectrum 412, 413 of a region of the surface of the image carrier 101. As explained in connection with FIG. 3, the reflection spectrum 412, 413 may be detected by a sensor 301. The reflection spectrum 412, 413 may indicate the intensity 401 of light which was reflected by the region of the surface of the image carrier 101. The intensity 401 of the reflected light may be indicated for different wavelengths 402.

The method 500 additionally includes the determination 502—on the basis of the reflection spectrum 412, 413—of whether a negative effect is present at the region of the surface of the image carrier 101. Furthermore, a type of negative effect may be determined on the basis of the reflection spectrum 412, 413. For example, the negative effect may include a film formation on and/or a mechanical defect of the surface of the image carrier 101. Via the analysis of the reflection spectrum 412, 413, it may be efficiently and reliably determined whether a negative effect on the image carrier 101 is present. In particular, for this purpose the image carrier 101 does not need to be removed from the print group 11, 12 and subsequently installed again, such that the danger of damaging the image carrier 101 upon a removal or installation is avoided.

The method 500 may moreover include the determination of a reference spectrum 411 for the region of the surface of the image carrier 101. The reference spectrum 411 thereby shows the reflection spectrum from the region of the surface of the image carrier 101 if no negative effect is present. In other words: the reflection spectrum indicates how the reflection spectrum from the region of the surface of the image carrier 101 should appear if no negative effect (for example no film formation and/or no mechanical defect) is present.

On the basis of the reference spectrum 411, it may then also be determined whether a negative effect is present at the region of the surface of the image carrier 101. In particular, the determined reflection spectrum 412, 413 may be compared with the reference spectrum 411. On the basis of the comparison, it may then be decided whether a negative effect is present or not. Furthermore, a type of the negative effect may be determined.

For example, a value of a distance measure between the reference spectrum 411 and the reflection spectrum 412, 413 may be determined in a defined wavelength range. For example, the distance measure may encompass a mean difference or a mean quadratic difference of the intensities 401 of the reference spectrum 411 and of the reflection spectrum 412, 413 in the wavelength range. The wavelength range that forms the basis of the determination of the distance measure may thereby depend on the toner (in particular on the absorption spectrum of the toner) that is applied to the surface of the image carrier 101 in the print group 11, 12. The distance measure may thus be adapted to the effects of a film formation that is to be expected. In particular, the significance of the determined value of the distance measure for the presence of a negative effect may thus be increased.

It may be determined that a negative effect on the region of the surface of the image carrier 101 is present if the value of the distance measure reaches or exceeds a predefined distance measure threshold. For example, the value of the distance measure may indicate that the determined reflection spectrum 412, 413 in the wavelength range has a (mean) intensity 401 that lies within a defined extent below the (mean) intensity 401 of the reference spectrum 411 in this wavelength range. Such an attenuation of the reflection spectrum 412, 413 then indicates the presence of a film formation and/or of a mechanical defect.

The method may additionally include the comparison of a curve of the reference spectrum 411 and a curve of the reflection spectrum 412, 413 (in particular in the wavelength range). Depending on the comparison of the curve, it may then be determined whether a film formation on the region of the surface of the image carrier 101 or a mechanical defect of the region of the surface of the image carrier 101 is present. For example, via the comparison of the curves it may be determined that the reflection spectrum 412, 413 has a curve that corresponds to the curve of the reference spectrum 411 in the wavelength range but that is attenuated by a specific factor or percentile relative to the curve of the reference spectrum 411 in the wavelength range (as depicted in FIG. 4*a*, for example). Examples of factors are 10%, 15% and in particular 20% or more. Such a situation is an indication of a film formation of the surface of the image carrier 101 that may be remedied via a cleaning of the image carrier 101. If applicable, the cleaning of the image carrier 101 may take place via a cleaner 103 of the print group 11, 12, such that a removal of the image carrier 101 may be avoided.

On the other hand, via the comparison of the curves it may be determined that the reflection spectrum 412, 413 has a curve that differs significantly from the curve of the reference spectrum 411 in the wavelength range. For example, it may be determined that the curve of the reference spectrum 411 may not be transformed—via multiplication by an attenuation factor—into the curve of the reflection spectrum 412, 413 (as depicted in FIG. 4*b*, for example). Such a situation is an indication of a mechanical defect of the surface of the image carrier 101, which typically may only be remedied via an exchange of the image carrier 101.

In order to compare a first curve $IR_1(f)$ of a first reflection spectrum 412, 413 with a second curve $IR_2(f)$ of a second reflection spectrum 411, a factor d may be determined so that a distance measure E between $d \cdot IR_2(f)$ and $IR_1(f)$ is reduced (minimized, if possible). For example, the distance measure E may include a mean quadratic difference between $d \cdot IR_2(f)$ and $IR_1(f)$ in a range (relevant to the color of the toner) of wavelengths 402. If the value of the distance measure E is less than or equal to a predefined first threshold, it may thus be determined that the first curve and the second curve are the same (and thus that a film formation is present on the surface of the image carrier 101). On the other hand, if the value of the distance measure E is greater than or equal to a predefined second threshold, it may thus be determined that the first curve deviates from the second curve (and thus that a mechanical defect of the surface of the image carrier 101 is present). The second threshold is thereby greater than or equal to the first threshold. For example, the first threshold may indicate a relative distance measure (relative to a mean intensity of $d \cdot IR_2(f)$ in the considered wavelength range) of 10% or less. The second threshold may indicate a relative distance measure (relative to a mean intensity of $d \cdot IR_2(f)$ in the considered wavelength range) of 10% or more.

The method 500 may additionally include the determination of whether the reflection spectrum 412, 413 includes interferences with a predefined intensity 401 and/or with a predefined periodicity. The interferences typically produce periodic fluctuations of the intensity 401 of the reflection spectrum 412, 413 with the wavelength 402 (as depicted in FIG. 4*c*). The interferences (in particular the periodicity of the interferences along the wavelength 402) is typically dependent on the thickness of a photoconductive layer of the image carrier 101 (if the image carrier comprises a photoconductor). It may be determined that the region of the surface of the image carrier 101 has a mechanical defect if it is determined that the reflection spectrum 412, 413 includes no interferences with the predefined intensity 401 and/or with the predefined periodicity; and/or that—although the reflection spectrum 412, 413 includes interferences—these interferences exhibit an intensity deviating (by a defined factor) from the predefined intensity and/or a periodicity deviating (by a defined factor) from the predefined periodicity). This situation is an indication that the photoconductive layer of the image carrier 101 is damaged.

As depicted in FIG. 2, the image carrier 101 may be arranged on a (cylindrical) image carrier roller. Furthermore, the reflection spectrum 412, 413 may be detected by a sensor 301 that, with a measurement slit 302, may be moved lateral to the image carrier roller. The image carrier roller may be rotated and/or the sensor 301 may be moved coaxial to the image carrier roller in order to determine the reflection spectrum 412, 413 for different regions of the surface of the image carrier 101, and in order to determine whether a negative effect is present for different regions of the surface of the image carrier 101.

Analogous to the method 500, in this document a print group 11, 12 for an electrographic (in particular an electrophotographic, for example an electrophoretic) digital printer 10 is also described that is set up to efficiently and reliably determine whether a negative effect is present on the surface of an image carrier 101 of the print group 11, 12. The print group 11, 12 comprises the image carrier 101 for the creation of a latent print image and to receive toner particles depending on said latent print image. An inked image is generated via the receipt of toner particles. The toner particles transfer to the surface of the image carrier 101 depending on the latent print image, and the inked image that is created is transferred from the image carrier 101 to a recording medium 20. For this purpose, the print group 11, 12 typically comprises a transfer station 120 for the transfer of the inked image onto the recording medium 20. Moreover, the print group 11, 12 may comprise a cleaner 103 to clean the image carrier 101 after transfer of the inked image.

The print group 11, 12 additionally comprises a light source 102, 301 that is set up to illuminate a region of a surface of the image carrier 101. The light emitted by the light source 102, 301 may be reflected on the surface of the image carrier 101 and thus may be used to determine a reflection spectrum 412, 413. For this purpose, the emitted light includes typical light components in the wavelength range for which a reflection spectrum 412, 413 should be determined.

The image carrier 101 may comprise a photoconductor. The print group 11, 12 may comprise an erasure light 102 that is set up to reduce an electrical charge on the surface of the photoconductor. The light source may then comprise the erasure light 102. In other words: the erasure light 102 may be used not only to bring the photoconductor into a defined electrical state before the generation of a latent print image. The erasure light 102 may also be used as a light source for the determination of the reflection spectrum 412, 413. The costs and the structural space for the determination of the reflection spectrum 412, 413 may thus be reduced.

The print group 11, 12 additionally comprises a sensor 301 that is set up to detect a reflection spectrum 412, 413 from the region of the surface of the image carrier 101. The sensor 301 may comprise a spectrometer that is set up to separate the light from the light source 102, 301 (which light is reflected by the region of the surface of the image carrier 101) into a plurality of light components with different wavelengths 402. Furthermore, the sensor 301 may comprise one or more photosensors that are set up to detect a plurality of intensities 401 of the plurality of light components. The reflection spectrum 412, 413 may thus be determined by means of the sensor 301, which reflection spectrum 412, 413 indicates a corresponding plurality of intensities 401 of the reflected light for a plurality of wavelengths 402 of said reflected light. The intensity 401 of the reflected light may, for example, include a quadratic mean of the amplitude of the reflected light.

Moreover, the print group 11, 12 comprises an analyzer 303 that is set up to detect a negative effect on the region of the surface of the image carrier 101 on the basis of the reflection spectrum 412, 413. The analyzer 303 may be set up to execute the method 500 described in this document.

A negative effect on the surface of an image carrier 101 of a print group 11, 12 may be efficiently detected via the determination of a reflection spectrum 412, 413. An unnecessary installation and removal of the image carrier 101 (and the danger of a mechanical damage that is linked with this) may thus be avoided.

REFERENCE LIST

10 digital printer
11, 11*a*-11*d* print group (front side)
12, 12*a*-12*d* print group (back side)
20 recording medium
20' print image (toner)
20" transport direction of the recording medium
21 roll (input)
22 take-off
23 conditioning group
24 turner
25 register
26 pulling group
27 take-up
28 roll (output)
30 fixer
40 climate control
50 power supply
60 controller
70 fluid management
71 fluid control
72 reservoir
100 electrophotography station
101 image carrier (photoconductor, photoconductor roller)
102 erasure light
103 cleaner (photoconductor)
104 blade (photoconductor)

105 collection container (photoconductor)
106 charger (corotron)
106' wire
106" shield
107 air supply channel (aeration)
108 air exhaust channel (ventilation)
109 character generator
110 developer station
111 developer roller
112 reservoir chamber
112' fluid supply
113 pre-chamber
114 electrode segment
115 dosing roller (developer roller)
116 blade (dosing roller)
117 cleaning roller (developer roller)
118 blade (cleaning roller of the developer roller)
119 collection container (liquid developer)
119' fluid discharge
120 transfer station
121 transfer roller
122 cleaner (wet chamber)
123 cleaning brush (wet chamber)
123' cleaning fluid supply
124 cleaning roller (wet chamber)
124' cleaning fluid discharge
125 blade
126 counter-pressure roller
127 cleaner (counter-pressure roller)
128 collection container (counter-pressure roller)
128' fluid discharge
129 charger (corotron at transfer roller)
301 sensor
302 measurement slit
303 analyzer
401 intensity
402 wavelength
411, 412, 413 reflection spectrum
500 method to determine negative effects on the surface of an image carrier
501, 502 method steps Although preferred exemplary embodiments are shown and described in detail in the drawings and in the preceding specification, they should be viewed as purely exemplary and not as limiting the invention. It is noted that only preferred exemplary embodiments are shown and described, and all variations and modifications that presently or in the future lie within the protective scope of the invention should be protected.

I claim as my invention:

1. A method to analyze a surface of an image carrier of a print unit of an electrophotographic digital printer, comprising:

illuminating a region of the surface of the image carrier with a light source;

measuring the region of the surface of the image carrier to determine a reference spectrum for the region of the surface of the image carrier;

measuring the region of the surface of the image carrier to determine a reflection spectrum of the region of the surface of the image carrier, the reflection spectrum indicating an intensity of light for different wavelengths, said light being reflected from the region of the surface of the image carrier;

comparing the reflection spectrum with the reference spectrum; and determining a presence of a disturbance on the surface of the image carrier at the region of the surface of the image carrier based on the comparison of the reflection spectrum and the reference spectrum.

2. The method according to claim 1 wherein the reference spectrum is a reflection spectrum measurement of the region of the surface of the image carrier without the disturbance on the surface of the image carrier at the region of the surface of the image carrier.

3. The method according to claim 2 further comprising:

comparing a curve of the reference spectrum and of the reflection spectrum, the curve of the reference spectrum indicating an intensity of a light from the light source as a function of the wavelength; and depending on the comparison of the curve, determining whether a film formation is present on the region of the surface of the image carrier or whether a mechanical defect is present at the region of the surface of the image carrier.

4. The method according to claim 1 further comprising:

determining a value of a distance measurement between the reference spectrum and the reflection spectrum in a wavelength range; and determining that a negative effect is present at the region of the surface of the image carrier if the value of the distance measurement reaches or exceeds a predefined spacing threshold.

5. The method according to claim 4 wherein the wavelength range depends on a color of a toner that is applied on the surface of the image carrier in the print unit.

6. The method according to claim 1 further comprising:

determining whether the reflection spectrum includes interferences with a predefined intensity, wherein the interferences depend on a thickness of a photoconductive layer of the image carrier; and determining that the region of the surface of the image carrier exhibits a mechanical defect if it is determined that the reflection spectrum includes no interferences with a predefined intensity or includes interferences with an intensity that deviates from a predefined intensity.

7. The method according to claim 1 wherein:

the image carrier is arranged on an image carrier roller;

the reflection spectrum is detected by a sensor; and at least one of the image carrier roller is rotated and the sensor is moved lateral to the image carrier roller in order to determine the reflection spectrum for different regions of the surface of the image carrier, and in order to determine whether a negative effect is present for different regions of the surface of the image carrier.

8. The method according to claim 1 further comprising:

analyzing the reflection spectrum of the region of the surface of the image carrier; and differentiating between the disturbance being mechanical damage to the image carrier and the disturbance being a contamination on the surface of the image carrier based on the analysis of the reflection spectrum.

9. The method according to claim 8 wherein the analyzing comprises:

analyzing a degree of amplitude modulation of the reflection spectrum of the region of the surface of the image carrier.

10. The method according to claim 1 wherein the image carrier is a rotating image carrier.

11. The method according to claim 1 wherein the light source is an erasure light that is further configured to reduce an electrical charge on the surface of the image carrier.

12. A print unit for an electrophotographic digital printer, comprising:

a photoconductor configured to create a latent print image;

a developer station configured to generate an inked image by inking the latent print image with toner particles;

a transfer station configured to transfer the inked image onto a recording medium;

an erasure light configured to reduce an electrical charge on the surface of the photoconductor after transfer of the inked image;

a cleaner configured to clean the photoconductor after the reduction of the electrical charge and the transfer of the inked image, wherein the erasure light is further configured to illuminate a region of a surface of the photoconductor to facilitate a measurement of the surface of the photoconductor;

a sensor configured to detect a reflection spectrum from the illuminated region of the surface of the photoconductor, the reflection spectrum indicating an intensity of light for different wavelengths, said light being reflected from the region of the surface of the photoconductor; and an analyzer configured to detect, based on the reflection spectrum, a disturbance on the region of the surface of the photoconductor.

13. The print group according to claim 12 wherein the sensor comprises:

a spectrometer configured to separate light from the erasure light, said separated light being reflected from the region of the surface of the image carrier into a plurality of light components with different wavelengths; and a photosensor configured to detect a plurality of intensities of the plurality of light components.

* * * * *